US010094352B2

(12) United States Patent
Buelow et al.

(10) Patent No.: US 10,094,352 B2
(45) Date of Patent: Oct. 9, 2018

(54) SWIRL IMPINGEMENT PREFILMING

(71) Applicant: Delavan Inc, West Des Moines, IA (US)

(72) Inventors: Philip E. O. Buelow, West Des Moines, IA (US); Jason A. Ryon, Carlisle, IA (US); John E. Short, Norwalk, IA (US)

(73) Assignee: Delavan Inc., West Des Moines, IA (US)

( * ) Notice: Subject to any disclaimer, the term of this patent is extended or adjusted under 35 U.S.C. 154(b) by 0 days.

(21) Appl. No.: 14/182,422

(22) Filed: Feb. 18, 2014

(65) Prior Publication Data

US 2014/0158796 A1 Jun. 12, 2014

Related U.S. Application Data

(63) Continuation of application No. 13/767,402, filed on Feb. 14, 2013.

(60) Provisional application No. 61/809,582, filed on Apr. 8, 2013, provisional application No. 61/599,659, filed on Feb. 16, 2012.

(51) Int. Cl.

| | |
|---|---|
| ***F02M 61/16*** | (2006.01) |
| ***F23D 11/38*** | (2006.01) |
| ***F23R 3/28*** | (2006.01) |

(52) U.S. Cl.

CPC ..... *F02M 61/162* (2013.01); *F23D 11/38* (2013.01); *F23D 11/383* (2013.01); *F23R 3/28* (2013.01); *F23D 2213/00* (2013.01); *F23D 2900/11001* (2013.01); *F23D 2900/11101* (2013.01)

(58) Field of Classification Search

CPC .... B05B 1/02; B05B 1/06; B05B 1/14; B05B 1/26; B05B 1/262; B05B 1/267; B05B 1/341; B05B 1/3457; B05B 1/3473; B05B 1/12; F23R 3/14; F23R 3/28

USPC ..... 60/740, 743, 748; 239/509, 533.2, 499, 239/506, 513

See application file for complete search history.

(56) References Cited

U.S. PATENT DOCUMENTS

| | | | | |
|---|---|---|---|---|
| 3,680,793 | A | 8/1972 | Tate et al. | |
| 6,547,163 | B1 * | 4/2003 | Mansour et al. | 239/404 |
| 2009/0212139 | A1 * | 8/2009 | Thomson et al. | 239/590 |
| 2011/0031333 | A1 | 2/2011 | Short | |
| 2012/0196678 | A1 * | 8/2012 | Fujisawa et al. | 463/33 |
| 2012/0234944 | A1 * | 9/2012 | Overman | F23D 11/106 239/553.5 |
| 2012/0292408 | A1 | 11/2012 | Short | |
| 2013/0031905 | A1 * | 2/2013 | Slobodyanskiy | F23R 3/36 60/737 |
| 2014/0090394 | A1 * | 4/2014 | Low | F23R 3/28 60/776 |

* cited by examiner

*Primary Examiner* — Alexander Valvis
*Assistant Examiner* — Christopher R Dandridge
(74) *Attorney, Agent, or Firm* — Locke Lord LLP; Daniel J. Fiorello; Scott D. Wofsy

(57) ABSTRACT

A nozzle for injecting liquid includes a nozzle body defining a plurality of injection point orifices and an annular prefilmer positioned downstream of the injection point orifices for prefilming impingement of spray from the injection point orifices on the prefilmer. A swirl antechamber can be defined upstream of the injection point orifices for supplying a swirling liquid flow to the injection point orifices for impingement of a swirling flow on the prefilmer.

10 Claims, 3 Drawing Sheets

Fig. 2
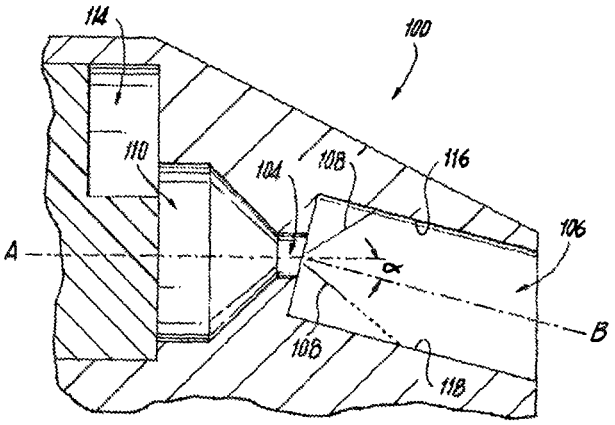
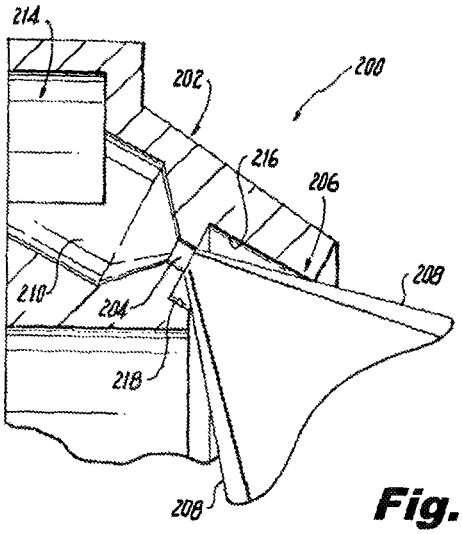
Fig. 3

SWIRL IMPINGEMENT PREFILMING

CROSS-REFERENCE TO RELATED APPLICATIONS

This application claims the benefit of priority to U.S. Provisional Patent Application No. 61/809,582 filed Apr. 8, 2013, and is a Continuation-in-part of U.S. patent application Ser. No. 13/767,402 filed Feb. 14, 2013, which claims the benefit of priority to U.S. Provisional Patent Application No. 61/599,659 filed Feb. 16, 2012, each of which is incorporated by reference herein in its entirety.

BACKGROUND OF THE INVENTION

1. Field of the Invention

The present invention relates to liquid injection and atomization, and more particularly to multi-point fuel injection such as in gas turbine engines.

2. Description of Related Art

A variety of devices are known for injecting or spraying liquids, and for atomizing liquids into sprays of fine droplets, such as for gas turbine engines. Pre-filming air-blast fuel injector nozzles for issuing atomized fuel into the combustor of a gas turbine engine are well known in the art. In this type of nozzle, fuel is spread out into a thin continuous sheet and then subjected to the atomizing action of high-speed air. More particularly, atomizing air flows through concentric air swirl passages that generate two separate swirling airflows at the nozzle exit. At the same time, fuel flows through a plurality of circumferentially disposed tangential ports and then onto a pre-filming surface where it spreads out into a thin uniform sheet before being discharged from the edge of the pre-filming surface into the cross-flowing air stream.

Because the cross-flowing air stream has a much higher kinetic energy it excites the lower kinetic energy fuel sheet. That interaction serves to shear and accelerate the fuel sheet, creating multiple modes of instability, which ultimately results in the fuel sheet breaking into ligaments of fuel. These fuel ligaments are similarly excited and broken into droplets. This is the primary mode of droplet formation, requiring that the cross-flowing air stream has sufficient energy to cause excitation.

Improvements in spray patternation have been made by recent developments in multi-point injection, in which a single injector can include multiple individual injection orifices. Exemplary advances in multi-point injection are described in commonly assigned U.S. Patent Application Publications No. 2011/0031333 and 2012/0292408. These designs employ swirl features formed or machined in injector components to generate swirl in flows of liquid and/or air issuing from each injection point.

Such methods and systems have generally been considered satisfactory for their intended purpose. However, there is an ongoing need in the art for further improvements in injection, such as improved filming characteristics, improved discharge coefficients, improved hydraulic cone angles, and the like. There also remains a need in the art for such improved systems and methods that are easy to make and use. The present invention provides a solution for these problems.

SUMMARY OF THE INVENTION

The subject invention is directed to a new and useful nozzle for injecting liquid. The nozzle includes a nozzle body defining a plurality of injection point orifices and an annular prefilmer positioned downstream of the injection point orifices for prefilming impingement of spray from the injection point orifices on the prefilmer.

The prefilmer is positioned to intersect spray cones defined by the injection point orifices. Swirl antechambers can be defined upstream of the injection point orifices for supplying a swirling liquid flow to the injection point orifices for impingement of a swirling flow on the prefilmer. A flow channel can be included in fluid communication with the injection point orifices, wherein the flow channel feeds into the swirl antechambers tangentially to generate swirl in a flow passing from the flow channel to the injection point orifices.

In accordance with certain embodiments, the prefilmer includes a prefilming chamber with opposed prefilmer walls, wherein one or both prefilmer walls are each positioned to intersect a spray cone defined by the injection point orifice. The prefilmer can define a prefilming chamber oriented along a prefilming axis, wherein each injection point orifice defines a spray axis, and wherein the prefilming axis and the spray axis are oriented obliquely relative to one another. It is also contemplated that the spray axis and prefilming axis can be aligned.

In some embodiments, the prefilmer includes a prefilming chamber with a single unopposed prefilmer wall configured so that only one side of a spray cone defined by the injection point orifice intersects the prefilmer and an opposing portion of the spray cone clears the prefilmer free of intersecting the prefilmer. It is also contemplated that in certain embodiments, the injection point orifice is aligned substantially normal to a prefilming wall of the prefilmer.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 2 is a cross-sectional side elevation view of a portion of another exemplary embodiment of a nozzle constructed in accordance with the present invention, showing the swirl antechamber, injection point orifice, and prefilmer;

FIG. 3 is a cross-sectional side elevation view of a portion of another exemplary embodiment of a nozzle constructed in accordance with the present invention, showing a prefilmer for prefilming only one side of the spray issued from the injection point orifice;

DETAILED DESCRIPTION OF THE PREFERRED EMBODIMENTS

Figure 1:
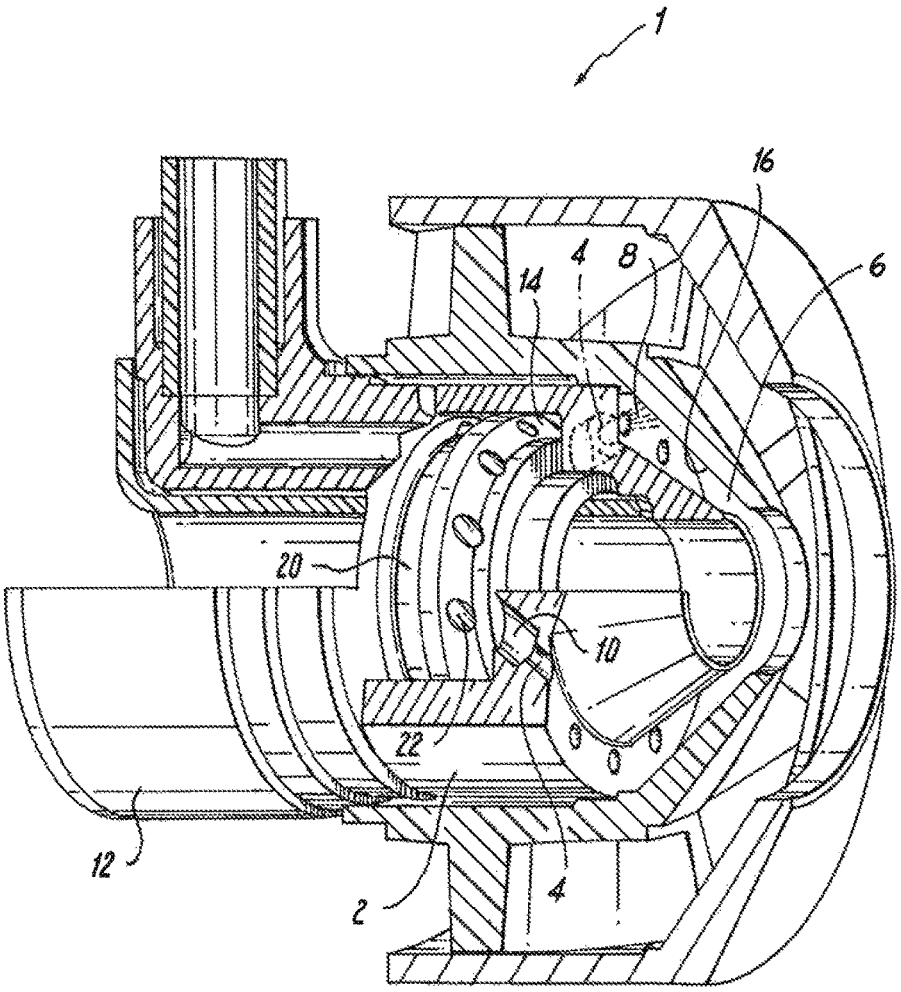
FIG. 1 is a cut away perspective view of an exemplary embodiment of a nozzle constructed in accordance with the present invention, showing the nozzle body and backing member.

Reference will now be made to the drawings wherein like reference numerals identify similar structural features or aspects of the subject invention. For purposes of explanation and illustration, and not limitation, a partial view of an exemplary embodiment of a nozzle in accordance with the invention is shown in FIG. 1 and is designated generally by reference character 100. Other embodiments of nozzles in accordance with the invention, or aspects thereof, are provided in FIGS. 2-5, as will be described. The systems and methods of the invention can be used to improve filming characteristics, discharge coefficients, hydraulic cone angles, and the like.

Referring now to FIG. 1, nozzle 1 includes a nozzle body 2 defining a plurality of injection point orifices 4, and a prefilmer 6 positioned downstream of injection point orifices 4 for impingement of spray on prefilmer 6. Injection point orifices 4 are oriented such that spray cones 8 issuing from orifices 4 impinge on prefilmer wall 16. Injection point orifices 4 are also oriented such that spray issuing from the orifices imparts swirl around prefilmer 6.

A respective swirl antechamber 10 is defined upstream of each injection point orifice 4 for supplying a swirling liquid flow to injection point orifice 4 for impingement of a swirling flow on prefilmer 6. A flow channel 14 is included in backing member 12. When backing member 12 is assembled onto nozzle body 2, channel 14 is in fluid communication with injection point orifice 4. In particular, flow channel 14 feeds into swirl antechamber 10 tangentially to generate swirl in a flow passing from flow channel 14 to injection point orifice 4. Backing member 12 includes a fluid inlet chamber 20 and has flow passages 22 defined through backing member 12 for fluid communication from fluid inlet chamber 20 to the flow channel 14. It is also possible for the flow channel to be defined in the nozzle body rather than in the backing member, for example as in channel 214 shown in FIG. 3. Flow passages 22 are angled relative to the central axis of nozzle 1 to impart a direction on flow into and around flow channel 14.

Figure 4:
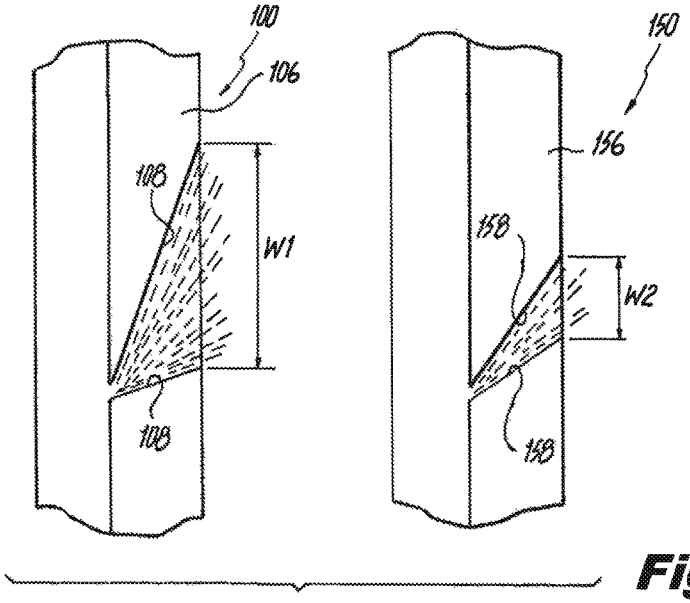
FIG. 4 is a schematic comparing film spreading on a prefilmer wall for an injection point orifice as in FIG. 1 on the left and on the right a conventional slotted fuel swirler.

With particular reference now to FIG. 2, another exemplary embodiment of a nozzle 100 is fed by a flow channel 114 similar to flow channel 14 described above. Prefilmer 106 includes a prefilming chamber with opposed prefilmer walls 116 and 118. Prefilmer walls 116 and 118 are each positioned to intersect spray cone 108. Although shown in plane in FIG. 2, swirl antechamber 110 and injection point orifice 104 may be oriented to direct spray out of, or into the page as illustrated in FIG. 4, in order to impart swirl to the flow in the prefilmer 106. In the exemplary embodiment shown in FIG. 2, swirl antechamber 110 and injection point orifice 104 are aligned along a spray axis A. Walls 116 and 118 are parallel to one another, and are oriented along a parallel prefilming axis B. The prefilming axis B and the spray axis A are oriented obliquely relative to one another at angle $\alpha$. Due to this relative angle, the upper portion of spray cone 108 intersects wall 116 upstream relative to where the opposite portion of spray cone 108 intersects wall 118, as oriented in FIG. 2.

While walls 116 and 118 are parallel, it is also contemplated that they can be angled relative to one another with a gap therebetween that increases or decreases in the direction away from injection point orifice 104. Moreover, those skilled in the art will readily appreciate that any suitable number of injection points can be used as appropriate for a given application. Prefilmer 106 is generally annular and with the plurality of multiple injection point orifices each configured as described above, provides for multipoint spray impingement prefilming.

Referring to FIG. 3, another exemplary embodiment of a nozzle 200 is shown. Injector 200 includes a nozzle body 202, injection point orifice 204, swirl antechamber 210, and flow channel 214 much as described above. Prefilmer 206 includes a prefilming chamber with a single unopposed prefilmer wall 216 configured so that only one side of spray cone 208 intersects prefilmer 206 and an opposing portion of the spray cone clears prefilmer 206 free of intersecting prefilmer 206, i.e. the inboard portion of the spray does not impinge on prefilmer wall 218, which is truncated or recessed relative to wall 216. Prefilmer walls 216 and 218 are parallel, and are aligned parallel to the axis defined by injection point orifice 204 and swirl antechamber 210. In other words, the spray axis and prefilming axis in nozzle 200 are aligned, unlike the oblique configuration described above with respect to FIG. 2. It is also contemplated that the inner wall could be positioned for impingement, with the outer wall recessed or truncated to avoid impingement. In short, the prefilmer wall lengths, heights, and angles (including inwards, axial, or outwards angles) can be selected for a given application so that fuel impinges on the inner wall, outer wall, or both, as needed.

With reference now to FIG. 4, prefilming impingement of spray provides for enhanced film spreading along prefilming surfaces due to the swirl that is imparted upstream of the injection point orifice 104 shown in FIG. 2. Prefilmer 106 in FIG. 4 is shown schematically flattened for illustrative purposes. Spray cone 108 is shown schematically spreading tangentially, and the film leaving prefilmer 106 has a width labeled W1. The spray spreads due to the tangential component of the swirling spray issuing from the injection point. The tangential component includes radially outward velocity local to the injection point.

The right hand prefilmer 156 is similarly depicted with a fuel stream 158 characteristic of a conventional slotted fuel swirler. The film leaving prefilmer 156 has a width labeled W2. The film represented by width W1 produced by nozzle 100 described above, is significantly wider than the film produced by a conventional prefilming nozzle 150. The overall prefilming area of nozzle 100 is significantly greater than for conventional nozzle 150. Greater prefilming area means the film thickness of the liquid issued is thinner, which results in better atomization and uniformity.

Figure 5:
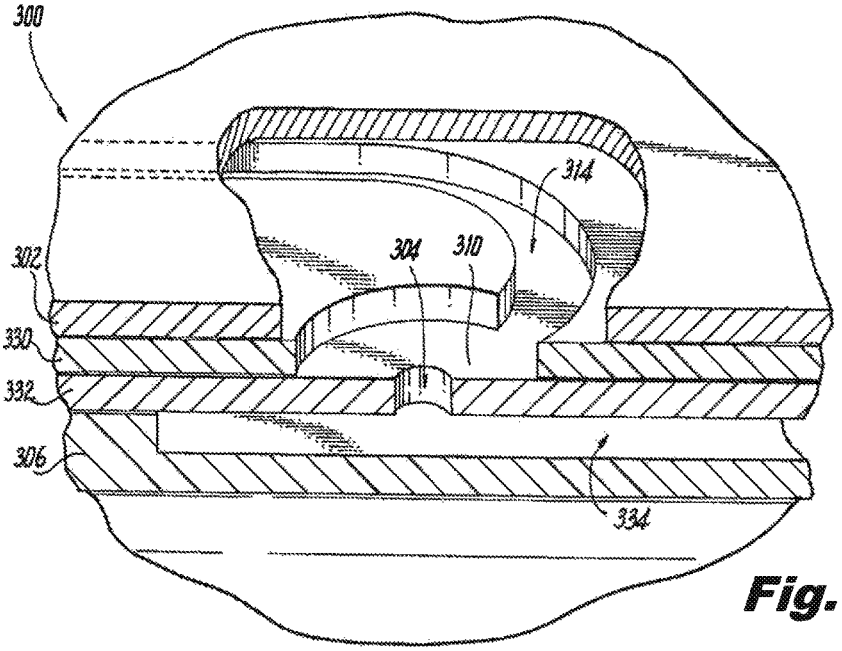
FIG. 5 is a cut away cross-sectional perspective view of a portion of another exemplary embodiment of a nozzle constructed in accordance with the present invention, showing an injection point orifice aligned substantially normal to the prefilming wall of the prefilmer.

Referring now to FIG. 5, it is also possible for the spray cone to be directed normal to a prefilming wall, as in another exemplary embodiment, namely nozzle 300. Nozzle 300 includes a nozzle body 302 mounted to a swirler body 330. Swirler body 330 defines a swirl antechamber 310 fed by a tangential flow channel 314. An orifice member 332 is mounted to swirler body 330 with an injection point orifice 304 aligned with the center of swirl antechamber 310 for enhanced swirl and pressure drop. Prefilmer 306 is mounted to orifice member 332, with a prefilming chamber 334 defined between prefilmer 306 and orifice member 332. The spray cone defined by injection point orifice 304 is substantially normal to the opposing wall of prefilmer 306, where the spray impinges. Since the spray is swirling, it spreads tangentially along the surface of prefilmer 306. Nozzle 300 is annular and injection point orifice 304 is directed radially inward toward the centerline defined by annular nozzle 300. While only one injection point is shown in FIG. 5 for sake of clarity, those skilled in the art will readily appreciate that multiple injection points are included around the circumference of nozzle 300 for issuing a prefilmed spray from prefilming chamber 334. Relative to conventional configurations, each injection point orifice 304 creates a larger prefilming area than a traditional slot or the like, so fewer individual injector points are needed. Any other suitable orientation of injection point orifices can be used, including radially outward, axial, tangential relative to the axis, or any combination.

In certain applications, impingement prefilming nozzles can provide a narrower hydraulic cone angle issuing from the prefilming chamber while still maintaining good film coverage compared to conventional nozzles. A conventional slotted prefilmer requires a tangential injection angle to provide good coverage of fuel on the prefilming surface. However, in impingement prefilming the spreading of the film is improved and the tangential injection angle of the orifice relative to the prefilming chamber can be reduced and still maintain good film coverage, which results in a lower hydraulic angle. This balance of swirl strength into the orifice coupled with the tangential injection angle of the orifice into the prefilmer can be coupled to allow the nozzle design to be tailored in both spray and film coverage as well as hydraulic angle of the film as suitable for specific applications.

Swirling of the flow through an injection point orifice can provide another potential advantage of impingement prefilming. Since swirling flow through an orifice has a lower discharge coefficient than in non-swirling flow through an orifice, the passage size can be increased while maintaining the same amount of flow. This reduces the likelihood of the passage becoming plugged, for example by foreign debris. Lower discharge coefficient also means that additional orifices can be added to a circuit to improve radial distribution of fuel without reducing the minimum passage size and still maintain the overall flow number.

Exemplary means for imparting swirl on the flow into injection point orifices have been described above. Those skilled in the art will readily appreciate that any other suitable means of introducing swirl can be used without departing from the scope of this disclosure. Other examples include pressure-swirl atomizer simplex points and air assist.

While shown and described in the exemplary context of fuel injection, those skilled in the art will readily appreciate that any other fluid can be used. Moreover, while described and shown in the exemplary context of gas turbine engines, multipoint prefilming as described above can be used in any other suitable application without departing from the scope of this disclosure.

The methods and systems of the present invention, as described above and shown in the drawings, provide for injection with superior properties including improved spray characteristics such as filming characteristics, discharge coefficients, and hydraulic cone angles. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A nozzle for injecting liquid comprising:

a nozzle body defining a plurality of injection point orifices and an annular prefilmer positioned downstream of the injection point orifices for multipoint prefilming impingement of spray from the injection point orifices on the prefilmer;

a plurality of swirl antechambers disposed circumferentially relative to each other, each swirl antechamber upstream of a respective one of the injection point orifices, for supplying a swirling liquid flow to each respective injection point orifice for impingement of a swirling flow on the prefilmer, wherein the plurality of swirl antechambers are larger in diameter than each respective injection point orifices; and a backing member disposed adjacent the nozzle body and defining an annular flow channel between the backing member and the nozzle body, the backing member in fluid communication with and upstream of the swirl antechambers, wherein the backing member partially obstructs an opening of the swirl antechambers to tangentially feed the swirl antechambers to cause swirling flow within the swirl antechambers.

2. A nozzle as recited in claim 1, further comprising a flow channel in fluid communication with the injection point orifices, wherein the flow channel feeds into the swirl antechambers tangentially to generate swirl in a flow passing from the channel to each injection point orifice.

3. A nozzle as recited in claim 1, wherein the prefilmer is positioned to intersect a plurality of spray cones, wherein one of the spray cones is defined by each injection point orifice.

4. A nozzle as recited in claim 3, wherein the prefilmer includes a prefilming chamber including opposed prefilmer walls, wherein at least one of the prefilmer walls is positioned to intersect the spray cones defined by the injection point orifices.

5. A nozzle as recited in claim 1, wherein the prefilmer includes a prefilming chamber with a single unopposed prefilmer wall configured so that only one side of each of a plurality of spray cones, one of the spray cones defined by each injection point orifice, intersects the prefilmer and an opposing portion of each spray cone clears the prefilmer free of intersecting the prefilmer.

6. A nozzle as recited in claim 1, wherein the injection point orifices are all oriented substantially normal to a prefilming wall of the prefilmer.

7. A nozzle as recited in claim 1, wherein the annular prefilmer has a radial cross-sectional profile that defines a prefilmer angle relative to a central axis defined by the annular prefilmer, wherein each injection point orifice defines a respective spray axis, and wherein the prefilmer angle is oblique relative to the spray axes.

8. A nozzle as recited in claim 1, wherein the annular prefilmer has a radial cross-sectional profile that defines a prefilmer angle relative to a central axis defined by the annular prefilmer, wherein each injection point orifice defines a respective spray axis, and wherein the prefilmer angle is aligned with all of the spray axes.

9. A nozzle for injecting liquid comprising:

a nozzle body defining an annular flow channel and a plurality of swirl antechambers in fluid communication with the annular flow channel and with an injection point orifice defined in each swirl antechamber, wherein the annular flow channel feeds into each swirl antechamber to impart a tangential flow component on fluids entering each swirl antechamber to generate swirl on a spray issuing from each injection point orifice, wherein each swirl antechamber is larger in diameter than each injection point orifice;

a backing member disposed adjacent the nozzle body and configured to impart swirling flow within the annular flow channel to tangentially feed the swirl antechambers to cause swirling flow within the swirl antechambers, wherein the backing member partially obstructs an opening of the swirl antechambers to tangentially feed the swirl antechambers to cause swirling flow within the swirl antechambers; and a prefilmer downstream of each injection point orifice, wherein the prefilmer is positioned to intersect a spray cone defined by each injection point orifice for prefilming impingement of swirling spray from each injection point orifice on the prefilmer.

10. A nozzle as recited in claim 9, further comprising a backing member mounted to the nozzle body, the backing member including a fluid inlet chamber and having at least one flow passage defined through the backing member for fluid communication from the fluid inlet chamber of the backing member to the flow channel of the nozzle body, wherein the at least one flow passage is angled to impart a direction on flow into the flow channel.

* * * * *